US005701957A

United States Patent [19]

Williamson et al.

[11] Patent Number: 5,701,957

[45] Date of Patent: Dec. 30, 1997

[54] WELL PERFORATOR ISOLATION APPARATUS AND METHOD

[75] Inventors: Dan Williamson; James A. Mills; John J. Ryan, III, all of Anchorage, Ak.

[73] Assignee: Halliburton Company, Dallas, Tex.

[21] Appl. No.: 596,819

[22] Filed: Feb. 5, 1996

[51] Int. Cl.[6] ..... E21B 43/11

[52] U.S. Cl. ..... 166/297; 166/55.1

[58] Field of Search ..... 166/297, 55, 55.1, 166/319; 175/4.52, 4.56

[56] References Cited

U.S. PATENT DOCUMENTS

| | | | |
|---|---|---|---|
| 3,589,453 | 6/1971 | Venghiattis | 175/4.6 |
| 3,706,344 | 12/1972 | Vann | 166/297 |
| 4,512,418 | 4/1985 | Regalbuto et al. | 175/4.56 |
| 4,564,076 | 1/1986 | Vann et al. | 175/4.52 |
| 4,605,074 | 8/1986 | Barfield | 175/4.52 |
| 4,637,468 | 1/1987 | Derrick | 166/297 |
| 4,656,944 | 4/1987 | Gonzalez | 102/312 |
| 4,756,371 | 7/1988 | Brieger | 166/312 |
| 5,329,999 | 7/1994 | White et al. | 166/129 |

*Primary Examiner*—Frank Tsay

*Attorney, Agent, or Firm*—William M. Imwalle; Paul I. Herman; John Booth

[57] ABSTRACT

Disclosed is an improved apparatus and method for performing downhole operations to a subterranean formation while isolating the formation from the remainder of the well bore. The invention utilizes a tool assembly which initially sets a packer above the formation while allowing a downhole tool to extend through a passageway in the packer to perform operations such as perforating the formation. The assembly permits retrieval of the tools through the passageway in the packer while sealing off the formation from the remainder of the well.

14 Claims, 8 Drawing Sheets

WELL PERFORATOR ISOLATION APPARATUS AND METHOD

TECHNICAL FIELD

This invention relates to well tools and processes of preparing subterranean formations in wells for production and more particularly to well tools and processes for performing downhole operations such as formation perforating and the like while isolating the subterranean formation from the remainder of the well.

BACKGROUND OF THE INVENTION

In the past it has been common to enhance production of a subterranean hydrocarbon formation by lowering a perforator assembly or the like into the well. The perforator assembly is aligned with the subterranean formation and the perforator is actuated to open or expose the formation. In some situations, perforation is performed below a temporary packer which was removed with the perforator once perforation is complete. Such procedures expose the hydrocarbon formation to caustic well fluids in the well bore. It has been found that the formation subsequently can be damaged by exposure to the well fluids during the period after the perforator assembly is removed and before the formation can be isolated from the remainder of the well. Therefore, an apparatus and method is needed to isolate the formation from well fluids while perforator assemblies or the like are removed from the well.

SUMMARY OF THE INVENTION

In accordance with the present invention, a tool assembly is provided which utilizes a production packer above a perforator tool to seal or isolate the perforated formation from the remainder of the well. A production assembly is connected to and located below the perforator. According to the method of the present invention, the tool assembly is lowered into position such that the perforator is adjacent the subterranean hydrocarbon-bearing formation. Thereafter the packer engages the casing above the formation. The perforator tool is operated to create fluid flow between the formation and the well. Once perforation is completed the perforator tool is retrieved through the packer. The production packer in the well remains in place above the formation. As the perforator tool is retrieved, the production assembly moves up to connect to and seal the packer. Finally, the perforator tool is disconnected from the production assembly and removed from the well.

In other embodiments the perforator tool can be replaced with different downhole tools used in other processes such as acidizing, stimulation, and other types of formation treatments and the like, where isolating the formation from the well fluids is necessary or desired.

BRIEF DESCRIPTION OF THE DRAWING

The accompanying drawing is incorporated into and forms a part of the specification to illustrate examples of the present invention. This drawing together with the description serves to explain the principles of the inventions. The drawings are only included for purposes of illustrating preferred and alternative examples of how the inventions can be made and used and are not to be construed as limiting the inventions to only the illustrated and described examples. Various advantages and features of the present inventions will be apparent from a consideration of the drawings in which.

DETAILED DESCRIPTION OF THE PREFERRED EMBODIMENT

Figure 1:
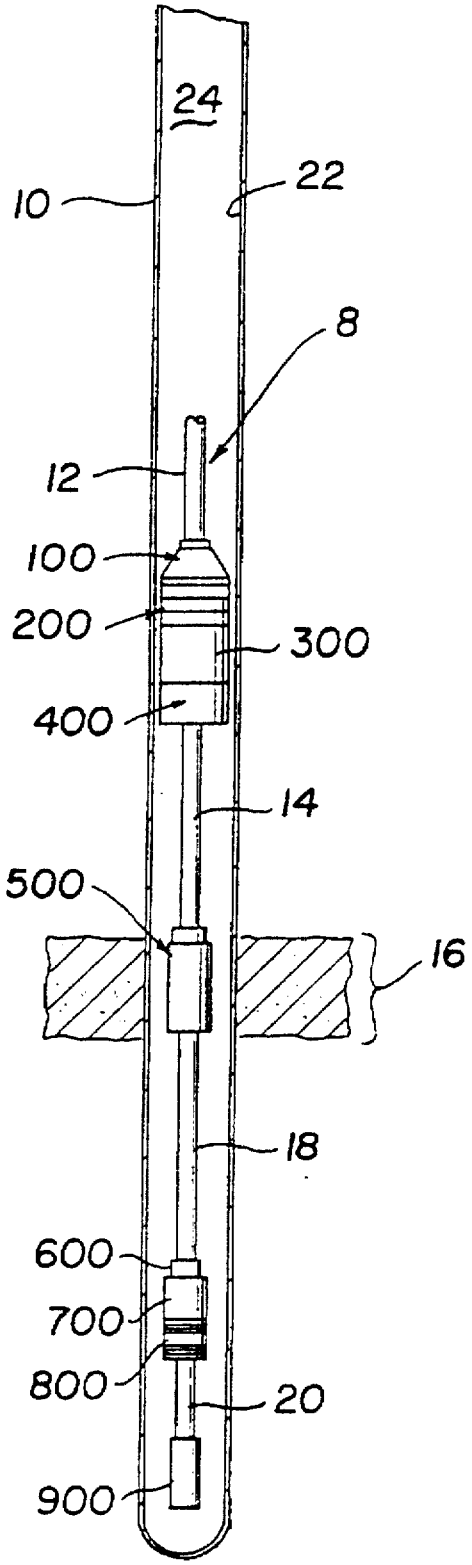
FIG. 1 is a schematic view of the lower portion of a well with the perforator isolation apparatus of the present invention positioned for practicing the well treatment method of this invention.

The present inventions will be described by referring to drawings showing and describing examples of how the inventions can be made and used. In these drawings the same reference characters are used throughout the several views to indicate like or corresponding parts. In these figures and the accompanying description arrow "C" is used to indicate the upward or uphole direction. The reverse of arrow "C" refers to the downward or downhole direction. The upward and downward directions used herein are for reference purposes only, and it is appreciated that not all wells extend vertically, and that the present inventions have utility in nonvertical well configurations.

In FIGS. 1 through 4, one example of a configuration using the present invention is shown schematically in the form of a well perforator isolation apparatus 8 positioned downhole in a well casing 10. Apparatus 8 is assembled at the surface and lowered by running tubing 12, wire line or the like. Apparatus 8 is positioned adjacent to a prospective hydrocarbon-bearing subterranean formation 16. Apparatus 8 is manipulated by running tool 100 connected to running tubing 12. Releasably connected to and supported from the running tool is a production packer 200 which in the embodiment shown is selectively operated by actuator 300. Located below and connected to actuator 300 is female latch assembly 400.

Figure 5:
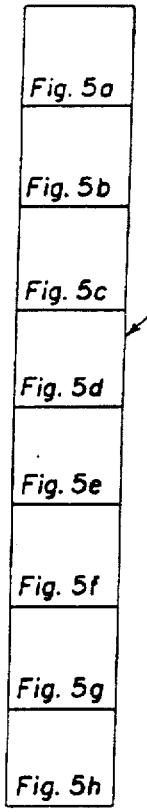
FIGS. 5*a*–5*h* together form FIG. 5 which is a longitudinal view in section and elevation of the perforator isolation apparatus of the present invention in a running condition.
Figure 5A:
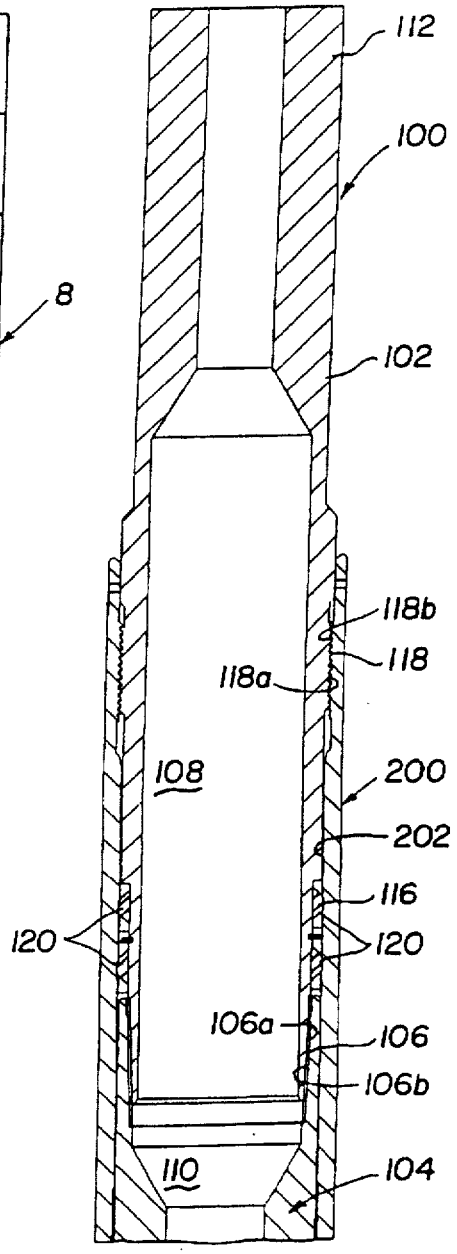
Figure 5B:
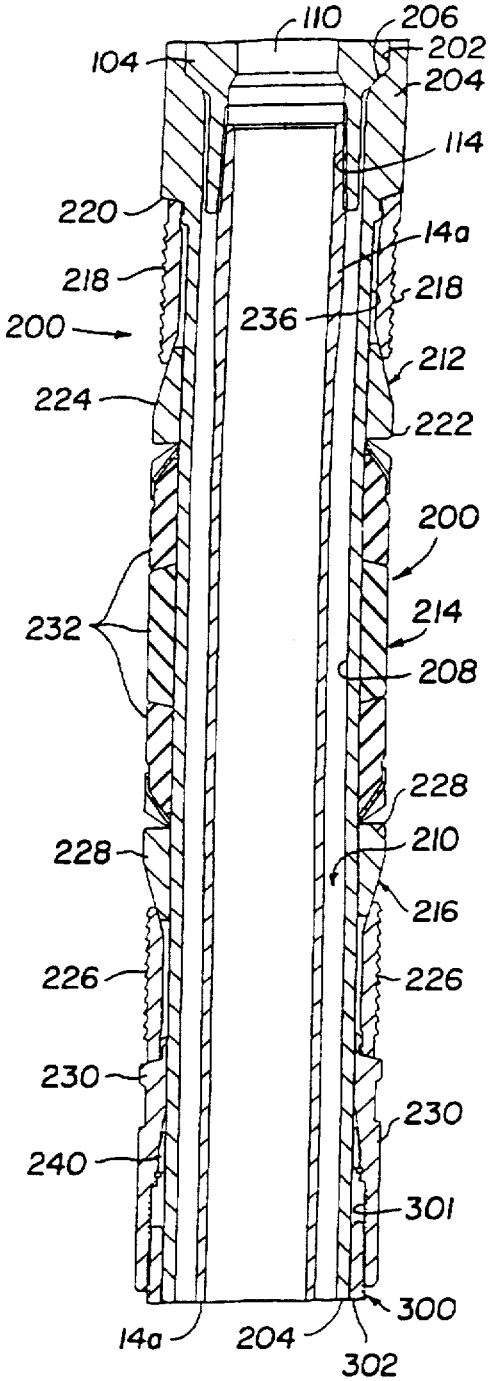
Figure 5C:
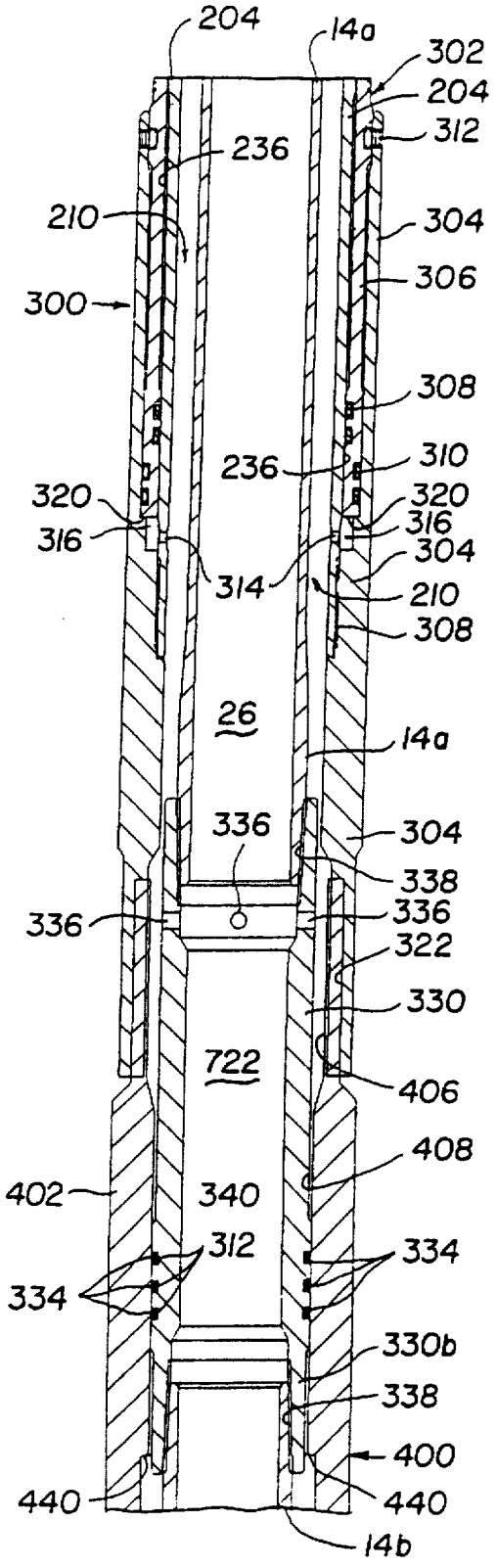
Figure 5D:
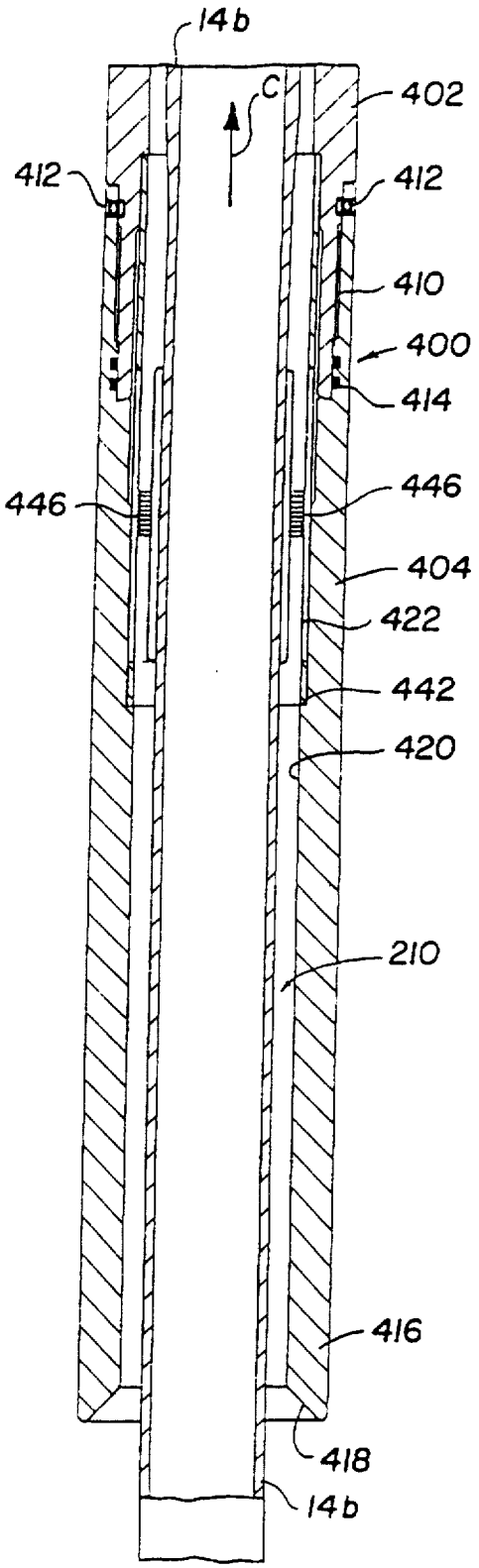
Figure 5E:
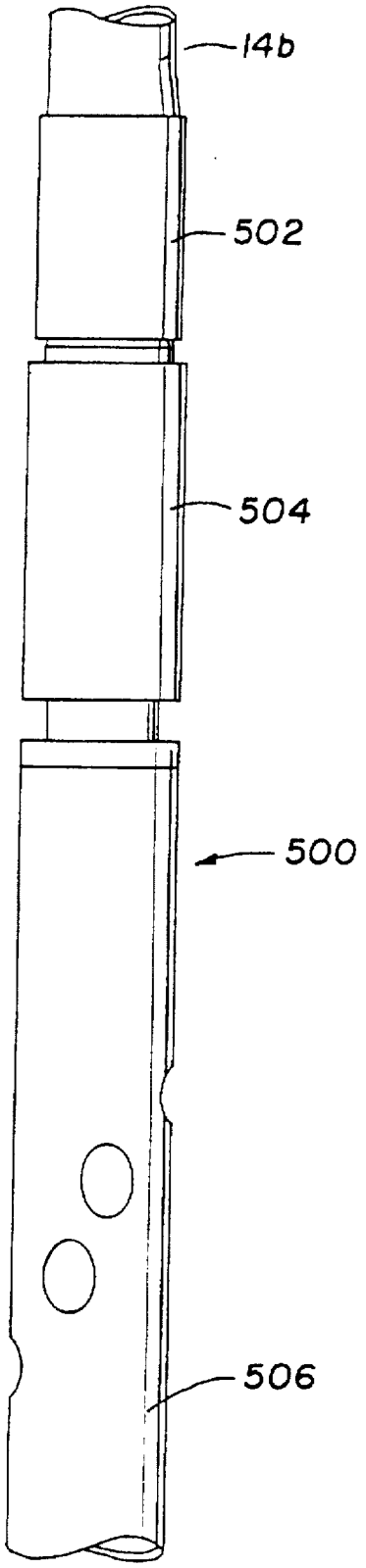
Figure 5F:
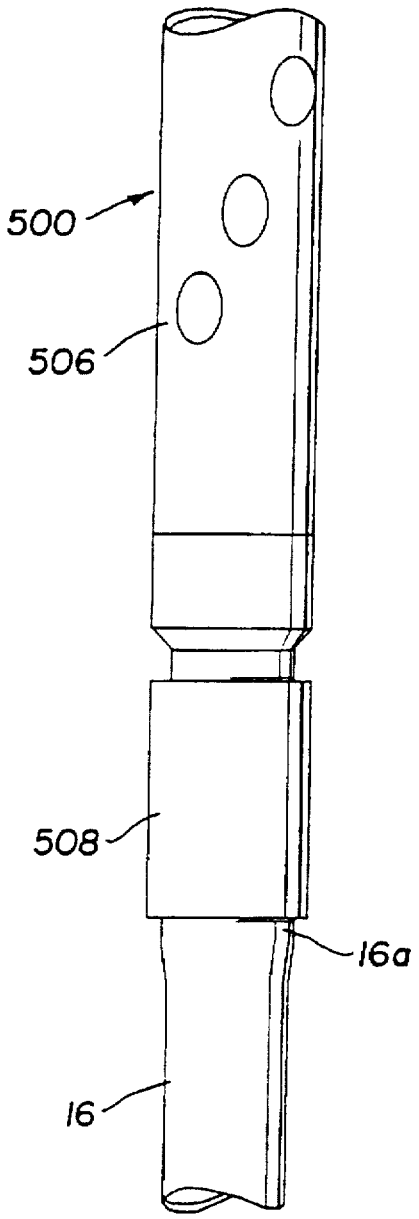

Referring briefly to FIGS. 5*b*, 5*c* and 5*d*, tubing 14 extends through a central passageway 210 defined in packer 200, actuator 300, and female latch 400 to running tool 100. Tubing 14 supports perforator assembly 500 shown positioned adjacent to subterranean formation 16. Perforator assembly 500 is used for perforating casing 10 and subterranean formation 16 as desired. Interconnection techniques well known in the art are utilized to interconnect these elements.

Figure 10:
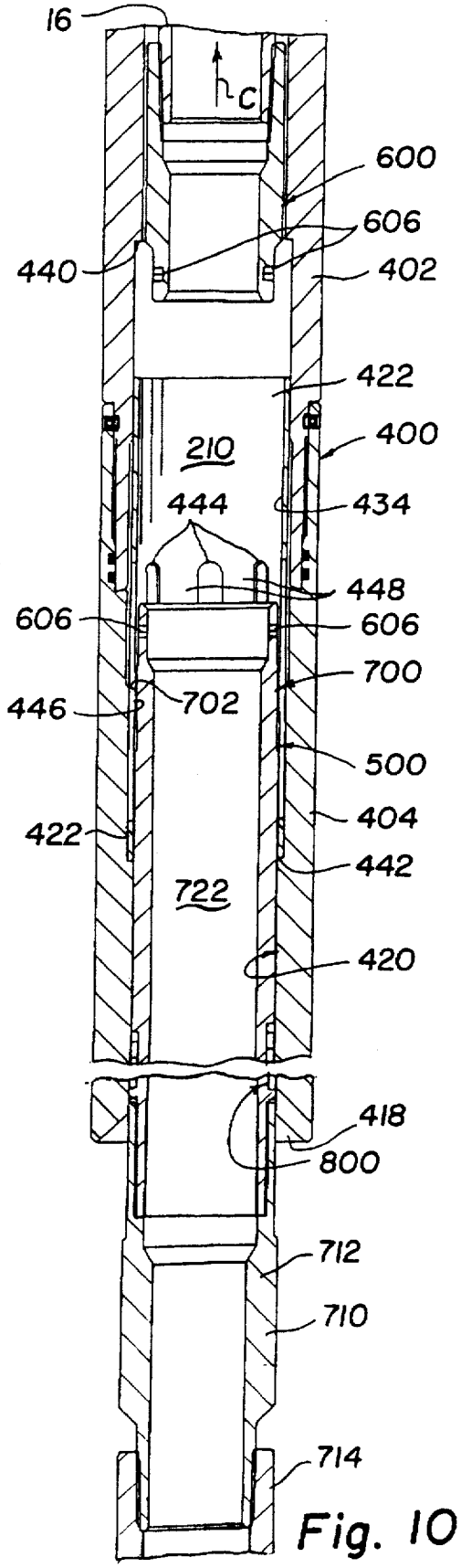
FIG. 10 is a fragmentary longitudinal section view illustrating the latch portion of the apparatus of the present invention.

Extending below and connected to perforator assembly 500 is tubing 18. A connector 600 releasably connects the lower end of tubing 18 to a male latch assembly 700. Supported below male latch assembly 700 is seal assembly 800. In the preferred embodiment, seal assembly 800 and male latch assembly 700 have a central passageway 722 (shown in FIG. 5g) providing a fluid passageway therethrough for connection to and fluid communication with well equipment located below seal assembly 800. Male latch assembly 700 fits axially into female latch assembly 400 to structurally connect the latch assemblies together as best illustrated in FIG. 10. Assembly 900 can terminate at the male latch assembly 700. Assembly 900 can comprise any suitable packer closure means such as a removable plug, a valve, a flow control device, a well treatment apparatus, a production assembly, or the like which closes off the packer 200, isolating the well bore 24.

Supported to extend below seal assembly 800 is a suitable tubing 20 connected to production assembly 900 for producing the petrochemicals contained in subterranean formation 16. Production assembly 900 is configured to remain downhole as desired and, for example, may comprise a tail pipe, plug, valve, or the like or a combination thereof. Preferably, assembly 900 has a remotely actuatable valve to stop fluid flow through tubing 20. It is envisioned that other types of equipment could be connected to or carried by seal assembly 800 and substituted for the joint and production assembly where appropriate, such as removable valves, plugs, and the like. For example, a removable plug or remotely actuatable valve could be attached to seal assembly 800 to close the central passageway 722 therein.

Figure 2:
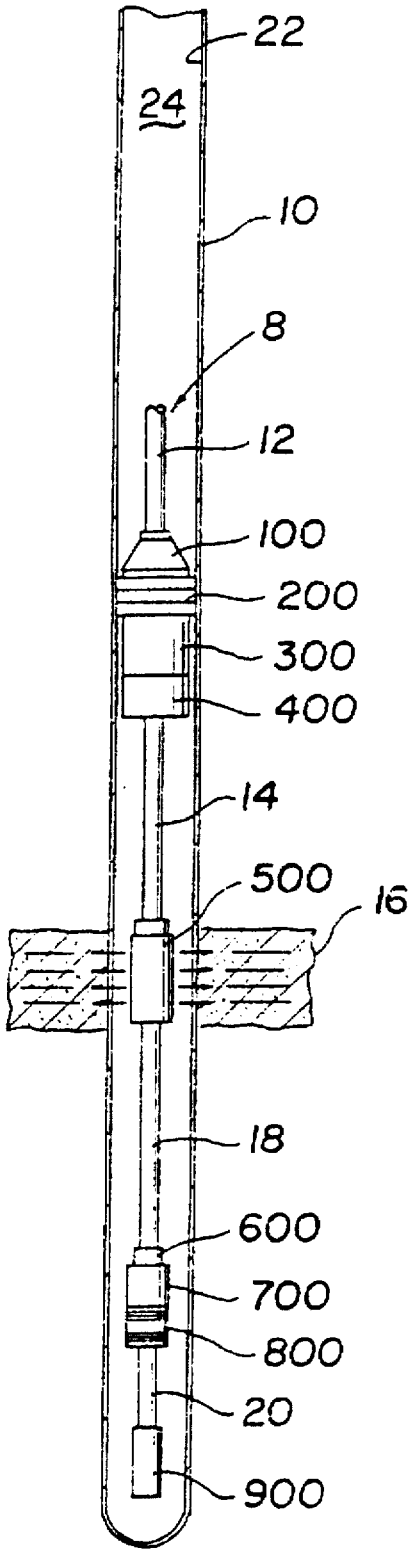
FIG. 2 is a schematic view similar to FIG. 1 showing the apparatus in position to perform the later steps of setting the packer and perforating the well of the well treatment method of this invention.

In FIG. 1 an initial step of the process of the present invention is shown with the apparatus 8 assembled and lowered into position adjacent to subterranean formation 16. In FIG. 2 actuator 300 has set or expanded packer 200 into a sealing and frictional engagement with interior wall 22 of casing 10 in a manner well known in the art. When set, packer 200 isolates formation 16 from the well fluids located in casing 10 above the packer 200. Once packer 200 is set, perforator assembly 500 is operated to perforate casing 10 and subterranean formation 16 to cause fluid communication.

Figure 3:
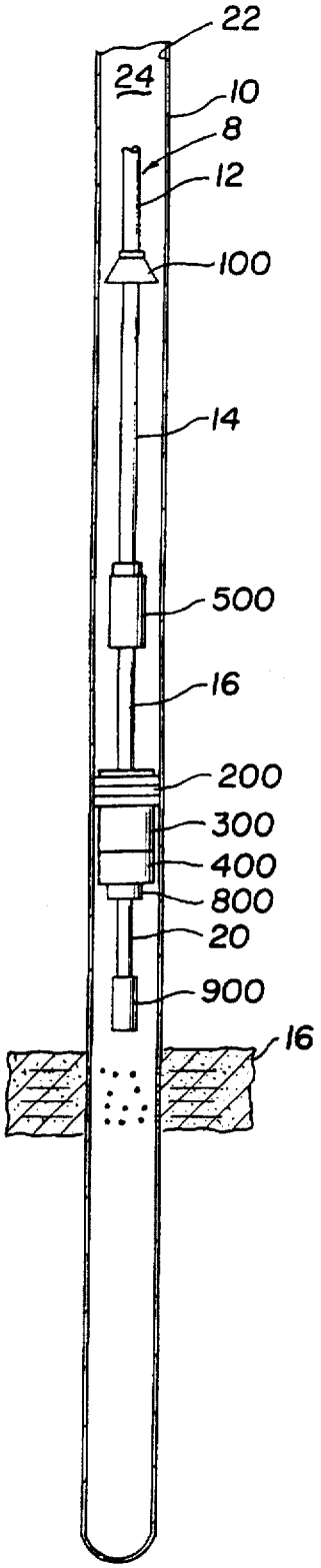
FIG. 3 is schematic view similar to FIG. 1 showing the apparatus in position to perform the step of pulling the perforator through the packer while sealing off the packer of the well treatment method of the present invention.

In accordance with the present invention, running tool 100 is detachably connected to the packer 200 with apparatus discussed later in detail. Running tool 100 can be remotely disconnected therefrom and moved upwardly as shown in FIG. 3. In this step, tubing 14, perforator 500 and tubing 18 are moved axially upward through central passageway 210 defined in packer 200, actuator 300 and female latch assembly 400, as illustrated in FIGS. 5b, 5c and 5d. According to the invention, the elements in isolation apparatus 8 between male latch 700 and female latch 400 are of a diameter sufficient to substantially close central passageway 210 but still axially pass through central passageway 210. The upward or uphole direction of retrieval coupled with the small clearances present in passageway 210 cooperate to substantially prevent if not completely block any passage of well fluids across the packer during the retrieval process. Referring to FIG. 3, as running tool 100 continues upward, male latch assembly 700 lands or axially telescopes into the central passageway of female latch 400. Male latch 700 latches or locks thereto. Seal assembly 800 axially telescopes into the interior of the female latch assembly 400 to mate with suitable seal surfaces in central passageway 210 of female latch assembly 400. When moved into place, assembly 800 seals the annular space between the male and female latches 700 and 400, accordingly.

Figure 4:
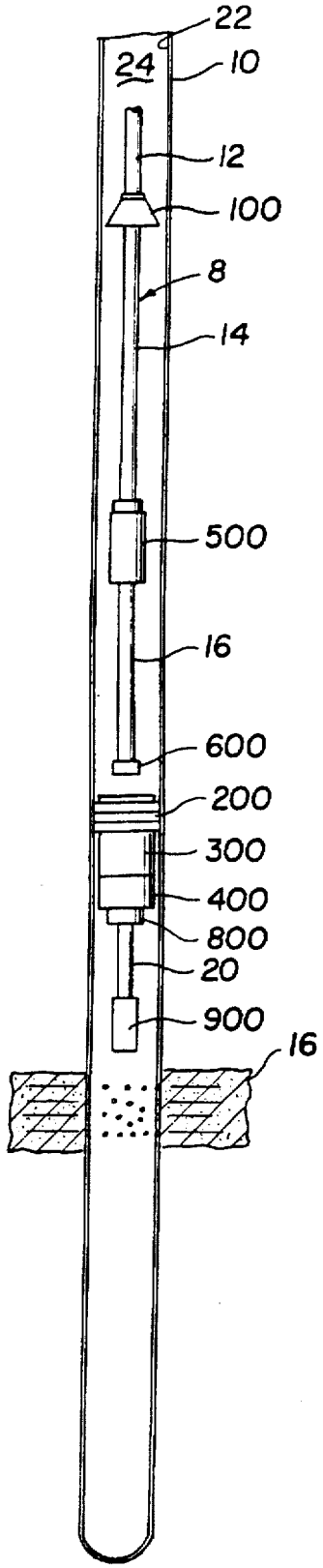
FIG. 4 is a schematic view similar to FIG. 1 showing the apparatus in position for performing the step of disconnecting the perforator assembly from the packer and retrieving the perforator of the well treatment method of the present invention.

In FIG. 4 releasable connector 600 is shown after separation from male latch assembly 700. Running tool 100 can be upwardly retrieved or removed from casing 10 with perforator assembly 500 and associated tubing 14 and 16. This step leaves the production packer 200 in place with the production assembly 900 connected thereto for use in well production. As discussed earlier, a valve unit in production assembly 900 selectively prevents fluid flow through production assembly 900.

According to one aspect of the process of the present invention, subterranean formation 16 is selectably isolated from well bore 24 by packer 200 during and following perforation of casing 10 and subterranean formation 16. Damage to subterranean formation 16 otherwise caused by exposure to the well fluids contained above the packer is substantially prevented. In a further step, production tubing can be placed in the well and connected to packer 200 and production assembly 900 to produce oil and gas from subterranean formation 16.

In FIG. 5 (FIGS. 5a through 5h) the details of an exemplary form of an apparatus 8 for use in perforating a well in accordance with the method of the present invention is illustrated. Apparatus 8 as illustrated in FIG. 5 is assembled and ready to be placed in well bore 24 (see FIGS. 1 through 4). The apparatus is shown in a running condition wherein the desired well service operation, such as perforation, can be performed.

Running tool assembly 100 is illustrated in FIGS. 5a and 5b. Running tool assembly 100 has a body 102 and a reducer 104. Both body 102 and reducer 104 are cylindrically shaped and are connected together by mating threads 106. Threads 106 comprise male threads 106a on the lower end of body 102 and female threads 106b on the upper end of reducer 104. Body 102 has a central passageway 108 which is in fluid communication with central passageway 110 formed in reducer 104. Upper end 112 of body 102 is illustrated as a blank for clarity. Upper end 112 can be provided with threads or other suitable coupling means well known in the industry for connecting running tool assembly 100 to running tubing 12 for use in manipulating isolation apparatus 8 into and out of well bore 24. Referring to FIG. 5b, mating threads 114 are provided in the lower end of the reducer 104 to threadedly engage upper end 14a of tubing 14. Mating threads 106 and 114 are locked in a conventional manner to prevent inadvertent disassembly of the connected parts during use downhole.

A conventional production packer 200 is releasably connected to the running tool 100 by mating threads 118. As illustrated in FIG. 5a male threads 118a are formed on the exterior of running tool 100 while mating female threads 118b are formed on the interior of the upper end of production packer 200. Threads 118 merely form a convenient means of releasably connecting production packer 200 to running tool 100 and other means known in the art can be used. Releasing or unscrewing the mating threads 118 allows retrieval of the running tool 100 while production packer 200 is in sealing and frictional engagement with the interior wall 22 of casing 10 as illustrated in FIGS. 2 through 4. It is to be understood that other means well known in the art of releasable connection could be used such as latches, shear pins, or the like. In the present embodiment threads 118 can be disengaged by rotating the running tubing 12 to mechanically separate running tool 100 from production packer 200. It will be appreciated that once the packer 200 is actuated and engaged the casing wall 22, packer 200 is prevented from rotating, allowing separation of running tool 100 therefrom.

In FIG. 5*a*, the upper end of the production packer assembly 200 is cylindrical in shape and has an interior chamber wall 202. Wall 202 is threaded at an upper end to form the female threads 118*b* of mating threads 118. Chamber wall 202 forms a cylindrical sealing surface for the seal assembly 116 carried on the exterior of the running tool. Seal assembly 116 comprises resilient elements which seal the annulus between the exterior of the running tool body of 102 and cylindrical interior chamber wall 202. Referring to FIG. 5*b*, chamber wall 202 extends axially to annular shoulder 206 which separates chamber wall 202 from a reduced diameter chamber wall 208. Walls 202 and 208 define an axially extending central passageway 210 through which tubing 14*a* extends.

In the illustrated embodiment, packer 200 is of the type which can be actuated to provide a seal in the annulus formed between the interior wall 22 of casing 10 and exterior surface of packer 200. The particular packer illustrated comprises an upper slip assembly 212 positioned above an expandable seal assembly 214. Seal assembly 214 in turn is positioned above a lower slip assembly 216. Slip assembly 212 comprises a plurality of circumferentially-spaced axially-extending slips 218 which are retained axially between shoulder 220 on body 204 and actuator ring 222. Actuator ring 222 is positioned to axially slide along the exterior surface 232 of body 204 and has an annular ramp surface 224. When ring 222 engages slips 218, slips 218 are flared in an outward direction to forcefully engage the surrounding casing wall 22. Lower slip assembly 216 is basically a mirror image of the upper slip assembly 212. Lower slip assembly 216 comprises a plurality of spaced axially extending slips 226 which are contained between actuator ring 228 and ring 230. Rings 228 and 230 are mounted around body 204 to slide axially to outwardly flare the slips 226 in a manner described with regard to slips 218.

Expandable seal assembly 214 is positioned between actuator ring 222 and actuating ring 228. In the embodiment shown, three resilient annular seals 332 are positioned on body 204. It should be noted that the number of seals 332 can vary with respect to the seal material selected and specific downhole environments. When seals 232 are axially compressed between rings 222 and 228 the seals expand to seal the annulus between the body 204 and interior wall 22 of casing 10.

Actuator assembly 300 is shown in FIG. 5*b* and FIG. 5*c*. Slip carrier ring 230 of packer assembly 200 is threaded at mating threads 301 to an annular piston 302 of actuator assembly 300. The actuator assembly selected for this embodiment is hydraulically operable. Annular piston 302 slides on the exterior cylindrical surface of body 204. This piston, when moved axially upward along the exterior of the body 204, causes the packer assembly 200 to set as previously described. In addition, a third set of slips or wedges 240 are positioned adjacent actuator ring 228 to lock the slip carrier ring 230 in the actuated position.

As illustrated in FIG. 5*c* piston 302 is captured between exterior surface 236 of body 204 and interior surface 304 of cylinder assembly 304. Cylinder assembly 304 is connected to the lower end of the body 204 by mating threads 308. Piston 302 is provided with internal and external annular seals 308 and 310, respectively. Internal seals 308 are conventional in design and provide a sliding seal engagement on the exterior surface 236 of body 204. External seals 310 are designed to seal the annulus between the exterior of the piston 302 and interior of the cylinder assembly 304. One or more shear pins 312 initially prevent relative axial movement between piston 302 and cylinder 304. Radially extending ports 314 in body 204 provide fluid communication between variable volume actuator chamber 316 and central passageway 210.

As shown in FIG. 5c the lower end of cylinder assembly 304 is connected to the upper end of female latch assembly 400 by threads 322. Female latch assembly 400 has an upper and lower cylindrical seal housing 402 and 404, respectively. Housing 402 has a cylindrical interior wall 406 forming cylindrical seal surface 408. Seal surface 408 is slightly reduced in diameter as compared to the adjacent interior wall 406 defining central passageway 210.

A seal subassembly 330 is connected to the lower end of tubing 14*a* by mating threads 338. Seal subassembly 330 has a plurality of ports 336 which communicate with the interior cavity 26 of tubing 14*a*. Outer surface 340 of seal assembly 330 defines grooves 312 which carries a plurality of annular seals 334. Seals 334 can be O-rings, packing, or the like. Seals 334 are selected to be of a size to mate with the seal surface 408 of upper seal housing 402 to seal the annulus between the exterior surface 340 of seal subassembly 330 and the interior of upper seal housing 402.

The lower end 330*b* of seal subassembly 330 is connected by threads 338 to tubing 14*b*. Tubing 14*b* is selected to be of a sufficient length to extend completely through and below female latch assembly 400. The lower extending end of tubing 14*b* is connected to and supports the perforator assembly 500, as will be described hereinafter.

It is to be noted that when isolation apparatus is in the running position as illustrated in FIG. 5 the annular seals 334 seal the lower end of central passageway 210 (see FIG. 5*c*) while seal assembly 116 seals the upper end thereof (see FIG. 5*a*). A plurality of radially extending ports 336 are formed in seal subassembly 330 to provide fluid communication between the interior cavity 26 of tubing 14*a* and central passageway 210. Ports 336 are used to remotely operate actuator assembly 300 to set packer 200.

Setting packer 200 is accomplished by increasing the pressure within the tubing 14*a* which is communicated through ports 336 to central passageway 210. Central passageway 210 is in fluid communication with variable volume chamber 316 through ports 314. As the pressure within the tubing 14*a* is increased, pressure in variable volume chamber 316 is likewise increased, applying a force to bottom 326 of annular piston 302 to hydraulically actuate the piston. Reacting to the hydraulic pressure present in variable volume chamber 316, piston 302 is urged in an upward direction with respect to cylinder 304. Pins 312 are manufactured and mounted in an engineered configuration to shear at a predetermined pressure present in variable volume chamber 316, allowing piston 302 to reciprocate with respect to cylinder 304 to actuate and set packer assembly 200.

In FIG. 5*d*, seal housings 402 and 404 are shown connected together by mating threads 410. To prevent inadvertent separation, a plurality of radially extending set screws or pins 412 lock the threads 410 in an assembled position. A plurality of annular seals 414 seal the joint between seal housings 402 and 404. Lower end 416 of lower cylindrical seal housing 404 is open and has a frustoconical guide surface at shoulder 418 formed therein. The interior of end 416 forms an axially ending cylindrical sealing surface 420.

Latch element 422 is located in the interior of female latch assembly 400 at the juncture of the upper and lower cylindrical seal housings 402 and 404. Details of the structure of the latch element 422 and its mounting within the female latch assembly 400 will be described by reference to the FIGS. 6, 7, and 8.

Figure 6:
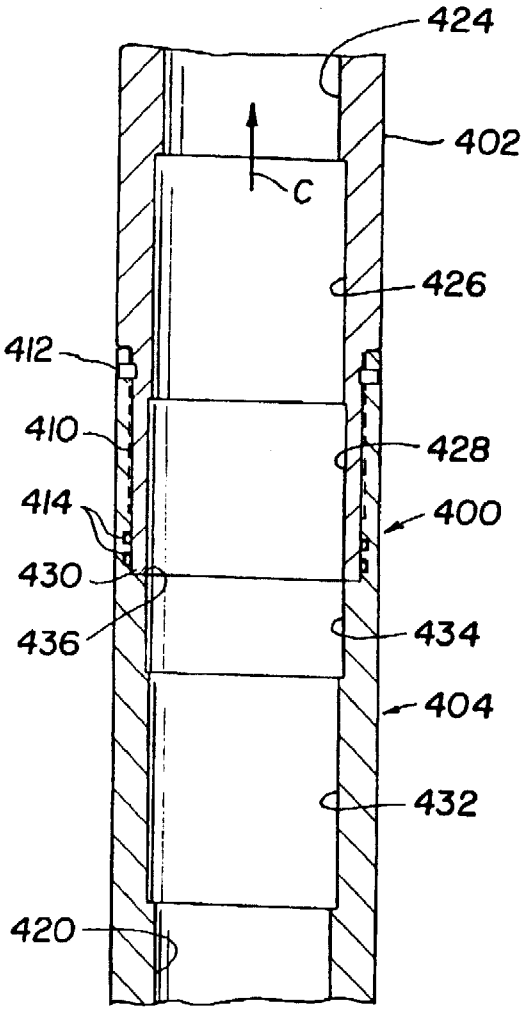
FIG. 6 is a fragmentary sectional longitudinal view illustrating the female latch portion of the apparatus of the present invention with the latch element removed for clarity.

In FIG. 6 the juncture between the upper and lower cylindrical seal housings 402 and 404 is shown the latch element 422 removed for clarity. The cylindrical inner wall 424 has a diameter which approximates the cylindrical sealing surface 420 in housing 404. Extending axially from and concentrically with cylindrical inner wall 424 is an enlarged diameter cylindrical recess 426. A second larger cylindrical recess 428 adjoins recess 426 and extends to the lower end 430 of housing 402. Recess 428 is cylindrical in shape and coaxial with recess 426 and slightly larger in diameter than recess 426. A recess 432 is formed in lower cylindrical seal housing 404 adjacent to sealing surface 420. Recess 432 is coaxial with surface 420 and is preferably selected to be of the same diameter as recess 426. A second recess 434 is formed in housing 404 and is located between recess 432 and shoulder 436 on housing 404. Recess 434 is coaxial with recess 432 and is preferably selected to be of the same diameter as the second recess 428 in upper seal housing 402.

Figure 7:
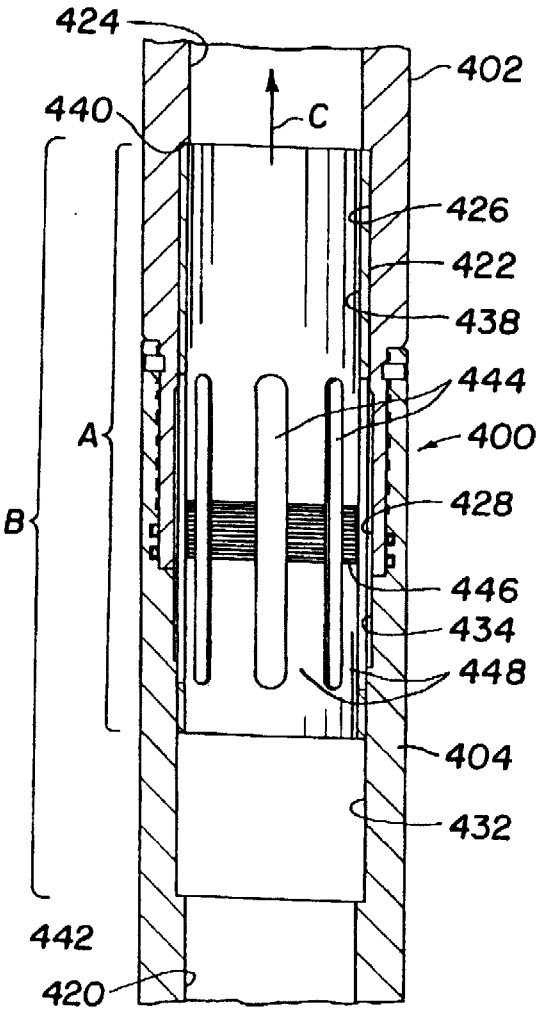
FIG. 7 is a fragmentary sectional longitudinal view illustrating the female latch portion with the latch element shown in the upper position.

In FIG. 7 latch element 422 is shown positioned within female latch assembly 400. Latch element 422 is a cylindrical member with a wall thickness substantially approximating the radial depth of recess 426 in upper housing 402 and recess 432 in lower housing 404. Interior wall 438 of latch element 422 has an internal diameter which substantially approximates the diameter of sealing surfaces 420 and 424. The outer diameter of latch element 422 is slightly smaller than the internal diameter of recesses 426 and 432 such that latch element 422 can slide relatively freely in an axial direction within the confines of the recesses 426 and 432. As is shown in FIG. 7, shoulder 440 defines the upper axial boundary of recess 426 while shoulder 440 defines the lower axial boundary of recess 432.

According to the features of the present invention latch element 422 has an effective axial length represented by dimension "A" which is less than the axial length between shoulders 440 and 442 represented by dimension "B." Latch element 422 can slide axially between shoulders 440 and 442 in the forward and reverse direction of arrow "C."

As illustrated in FIG. 7, latch element 422 has a plurality of axially extending slots 444 formed therein. Slots 444 are circumferentially spaced to extend through the wall of the latch element 422. A plurality of ratchet teeth 446 are formed on interior wall 438 of latch element 422. These ratchet teeth can be in the form of dogs or thread-like extensions from the surface of latch element 422. It is noted that the ratchet teeth 446 are located in the spring arms 448 between the slots 444. It is preferable that the latch element 422 be made of spring-like metallic material which can be deflected radially outward without permanent deformation.

When latch element 422 is in the position shown in FIG. 7 (or moved further in the direction of arrow "C" to a point where latch element 422 abuts shoulder 440) spring arms 448 are adjacent to recesses 428 and 434. In this position, the spring arms 448 can be deflected outward into the annular clearance defined between exterior surface 452 of latch element 422 and recesses 428 and 434, respectively.

Figure 8:
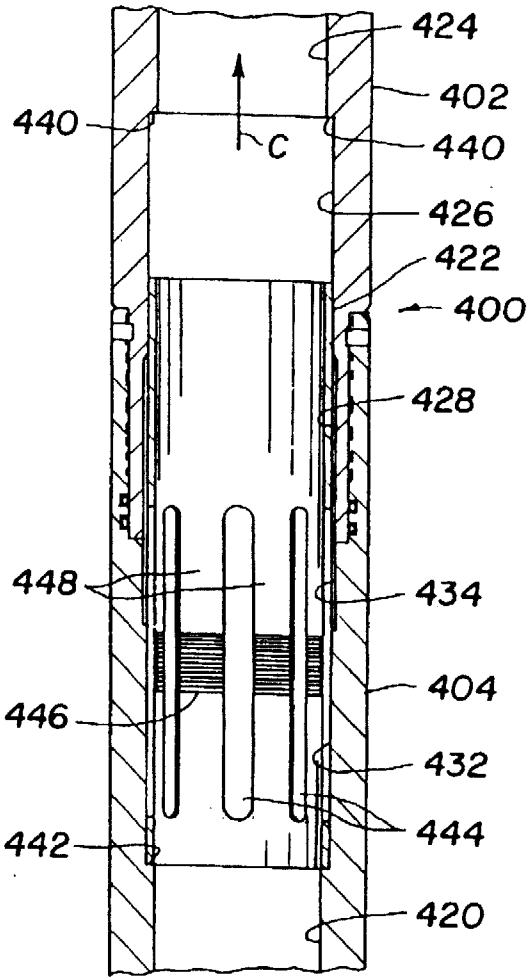
FIG. 8 is a fragmentary sectional longitudinal view illustrating the female latch portion with the latch element showing the lower position.

In FIG. 8 the latch element 422 is shown axially moved in a reverse direction of arrow "C" to abut shoulder 440. In this position the ratchet teeth 446 on spring arms 448 cannot deflect outward because of the close confines of the recess 432. That is, when ratchet teeth 446 are axially aligned with the enlarged diameter area formed by recesses 428 and 434, spring arms 448 can deflect outward into the annular clearance. When ratchet teeth 446 move adjacent to recess 432, the close proximity of the outer diameter of the latch element 422 and the inner diameter of the recess 432 prevents outward deflection of spring arms 448. As will be described in detail hereinafter, the axial movement of the ratchet teeth 446 into and out of the enlarged diameter recesses 428 and 434 is utilized to perform a latching function during removal of running tool 100, perforator assembly 500, and associated tubing 14 and 16.

Referring now to FIG. **5*e*, it can be seen that the lower end 14*b* of tubing 14 which extends through and below the female latch assembly 400 (see FIG. 5*d*) is connected by a suitable collar 502 to perforator assembly 500. Perforator assembly 500 is of the type which is commercially available in the industry and which can be remotely actuated once in proper position. Perforator assembly 500 has an actuator 504 and a gun 506. Perforator assembly 500 is selected for the particular application and can be used to perforate casing 10 and subterranean formation 16 where desired after the packer assembly 200** has been set.

Figure 5G:
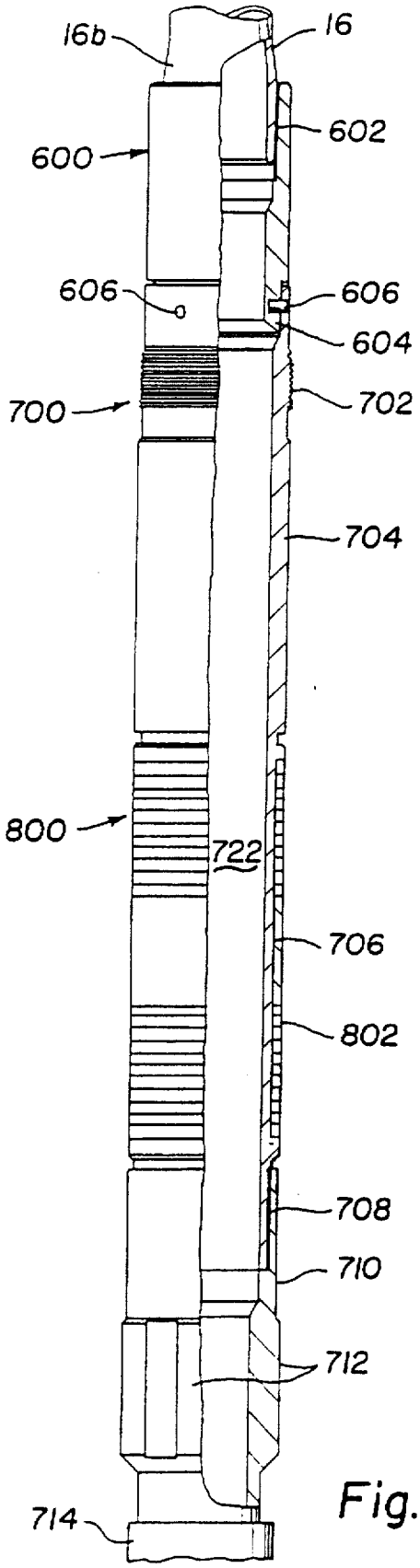

As shown in FIG. **5*f* a sleeve 508 connects the lower end of perforator 500 to the upper end 16*a* of tubing 16. Referring to FIG. 5*g*, tubing 16 is coupled at its lower end 16*b* through a releasable connector 600 to the upper end of the male latch assembly 700. The lower end of male latch assembly 700 is in turn connected to seal assembly 800**.

In the embodiment shown in FIG. **5*g*, releasable connector 600 is threaded at mating threads 602 to lower end 16*b* of tubing 16. The lower end of releasable connector 600 is necked down to form a cylindrical male end 604. Male end 604 telescopes into the upper end of male latch assembly 700 and is connected thereto by a plurality of shear pins 606. During retrieval of perforator assembly 500 and associated equipment, shear pins 606 are sheared to separate connector 600 from the upper end of male latch assembly 700**.

Male latch assembly 700 mates or engages with female latch assembly 400. In this regard the male latch assembly 700 has a plurality of circumferentially-extending, axially-spaced ratchet teeth 702 formed on the exterior thereof. Ratchet teeth 702 are selected to be of a size to mate with and engage ratchet teeth 446 of latch element 422 contained in female latch assembly 400. Ratchet teeth 700 are biased in a downward direction while ratchet teeth 446 are biased in an upward direction. The effective diameters of the teeth 446 and 700 are selected to provide an interlocking function that will be described later in detail.

Cylindrical housing 704 is reduced in diameter at its lower end 706 to receive a plurality of cylindrical packing elements 802 of the seal assembly 800. Packing elements 802 are selected to be of a size to mate with and seal with sealing surface 420 of the female latch assembly 400. Packing elements 802 are of a conventional design well known in the industry. The lower end of reduced portion 706 is threaded at mating threads 708 to collar 710. Radially extending circumferentially-spaced flutes 712 are formed on the lower end of collar 710.

According to a particular feature of the present invention, the outside diameter of the collar 600 illustrated in FIG. **5*g*** is slightly smaller in diameter than the central passageway 210 (see FIGS. 5*a* through 5*d*) which extend through packer assembly 200, actuator 300, and female latch assembly 400. Once shear pins 606 are sheared collar 600 can be removed from the well bore 24 via central passageway 210. Additionally, the external diameter of male latch assembly 700 and seal assembly 800 is selected to land or lock with the interior of the female latch assembly 400 when axially moved upward in the direction of "C." Flutes 712 on collar 710 are slightly larger in external diameter than cylindrical seal surface 420 in female latch assembly 400. It will be appreciated that flutes 712 contact shoulder 418 on the lower end of the female latch assembly 400 to prevent further upward movement of the male latch assembly 700 into the female latch assembly. Any continued upward force is then transferred to shear pins 606 which sever when sufficient upward force is applied, causing connector 600 to release male latch assembly 700.

Figure 5H:
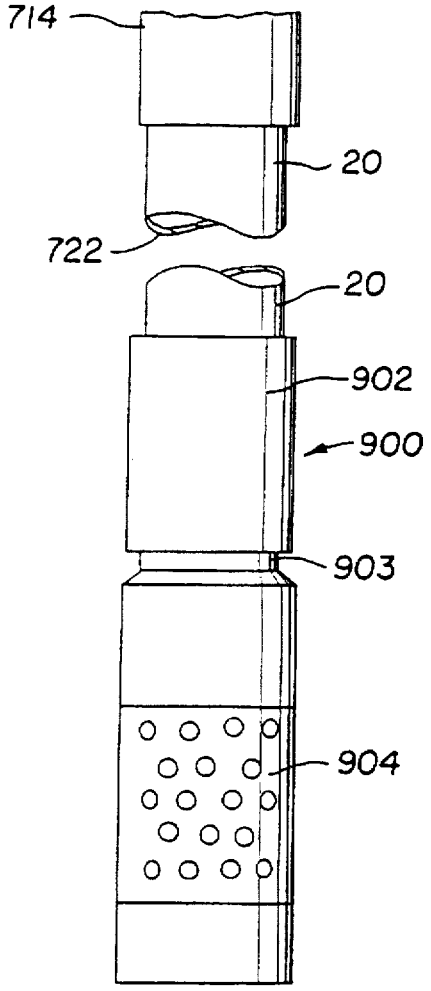

In FIG. 5*h*, collar 714 connects the lower end of collar 710 to tubing 20. Tubing 20 is of a length to place production assembly 900 at a desirable distance below packer 200 when male latch assembly 700 and female latch assembly 400 are in an engaged relation (see FIGS. 9 and 10). Production assembly 900 can be of any conventional design well known in the industry. Production assembly 900 can, for example, preferably have remotely-actuatable valve 902, perforated joint 903 and landing nipple 904. Valve 902 can be conventional in design and can, for example, be retrievable. A primary consideration of selecting valve 902 is that it can temporarily terminate the lower end of the tubing during the activation of perforator assembly and then be opened for well production.

Figure 9:
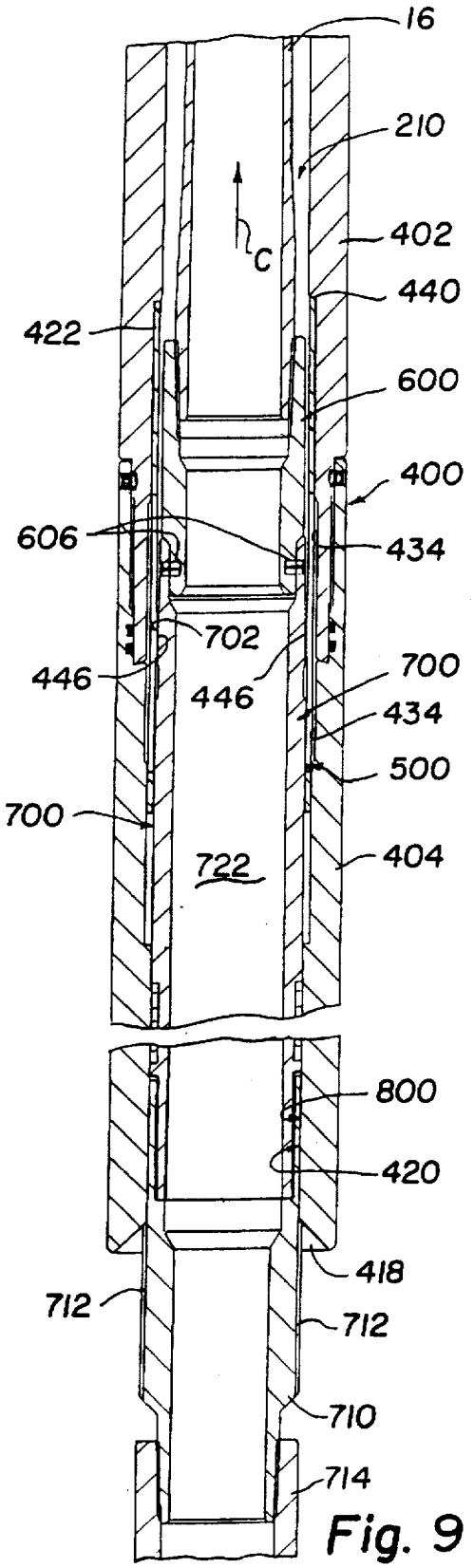
FIG. 9 is a fragmentary sectional longitudinal view illustrating the latch portion of the apparatus of the present invention.

Details of the interaction of male latch assembly 700 and female latch assembly 400 during the latching and retrieving steps shown in FIGS. 3 and 4 will be explained with reference to FIGS. 9 and 10. The sequence illustrated in FIG. 9 is present after perforation has been completed through casing 10 and subterranean formation 16 and after running tool 100 has been disconnected from packer 200. As discussed earlier, the diameter of perforation assembly 500 is such that it also has been removed through packer 200 and female latch assembly 400 via central passageway 210. FIG. 9 shows the occurrence of two further steps. First, flutes 712 engage shoulder 418 preventing further upward movement of the tubing 18 into female latch assembly 400. Second, ratchet teeth 702, because of the interference fit with ratchet teeth 446, causing latch element 422 to be moved axially upward within recesses 426 and 432. Upward movement of latch element 422 continues until shoulder 440 is engaged. Once shoulder 440 is engaged by latch element 422, ratchet teeth 702 impart an axially force against spring arms 448, causing spring arms 448 to deflect outward into the annular clearance defined between exterior surface 452 of latch element 422 and recesses 428 and 434, respectively. The deflection allows ratchet teeth 702 to slide upward with respect to ratchet teeth 446.

As illustrated in FIG. 9, the relative axial position of the recesses, ratchet teeth, and shoulder 440 are such that ratchet teeth 702 and 446 are engaged when further upward movement of tubing 18 is prevented by engagement of flutes 712 with shoulder 418. At this limit of upward movement, a jar or other upward force can be applied to tubing 16 sufficient to shear the pins 606, disengaging connector 600 from male latch assembly 700.

The effect of the sheared separation is illustrated in FIG. 10. As shown, once pins 606 are sheared, collar 600 and tubing 18 are free to move in the upward direction to be completely retrieved from the well bore 24. With respect to the present embodiment, perforation assembly 500 is retrieved along with collar 600 and tubing. As pins 606 are sheared, the weight of the elements suspended from male latch assembly 700 forces male latch 700 in the reverse direction of arrow "C." The interference or ratchet engagement of ratchet teeth 702 of male latch assembly 700 with ratchet teeth 446 of female latch assembly 400 cause latch element 422 to slide in a downward direction to engage shoulder 442. Such engagement by latch element 422 shown in FIG. 10 is that previously described with reference to FIG. 8.

In this position, ratchet teeth 446 have moved axially downward past the annular clearance defined between exterior surface 452 of latch element 422 and recesses 428 and 434, respectively. Outward radial deflection of spring arms 448 is prevented by recess 432, effectively locking ratchet teeth 702 and ratchet teeth 446 together to complete the latching operation.

These latching-separation steps described with reference to FIGS. 9 and 10 allows removal of unnecessary downhole-tooling assemblies while leaving a production assembly 900 supported below a packer which is sealed off by the engagement of seal assembly 800 with sealing surface 420. It should be noted that although the ratchet-type latch is advantageous in such applications, it is appreciated that connecting could be accomplished by other techniques such as by threading, J-slots, or the like.

The embodiment shown and described above is only exemplary. Many details which are omitted are well known in the art such as descriptions of the inner workings of perforator guns, remotely actuatable production valves, pinning nipples, and the like. Therefore, many such details are neither shown or described. It is not claimed that all the details, parts, elements, or steps described and shown were invented herein. Even though numerous characteristics and advantages of the present inventions have been set forth in the foregoing description, together with the details of the structure and function of the invention, the disclosure is illustrative only, and changes may be made in the detail, especially in the matters of shape, size, and arrangement of the parts within the principles of the inventions to the full extent indicated by the broad general meaning of the terms used in the attached claims. The restrictive description and drawings of the specific examples do not point out what an infringement of this patent would be, but are to provide at least one explanation how to make and use the inventions. The limits of the inventions and the bounds of the patent protection are measured by and defined by the following claims.

What is claimed is:

1. A method of perforating a well casing adjacent a subterranean well formation while isolating the formation from well fluids in the remainder of the well, comprising;

placing a remotely operable well packer, a well perforator and a packer closure in the well;

positioning the well packer in the well casing at a position in the well on an uphole side of the perforator and the packer;

operating the well packer to set the packer in a sealing position with the well casing to isolate the perforator and the packer closure from the remainder of well fluids located on the uphole side of the well packer;

operating the well perforator to perforate the well casing at a downhole position below the previously set well packer to provide fluid communication through the well casing wall between the interior of the well casing below the well packer while isolating the well perforation from the remainder of well fluids;

removing the previously operated well perforator from the well in an uphole direction by first passing through a passageway in the well packer and then out of the well to free the well of equipment unnecessary for further treatment or well production; and moving the packer closure in an uphole direction into contact with the well packer and connecting the packer closure to the well packer to close the packer passageway in the well to prevent fluid communication across the well packer and thereby completing the well perforation while isolating the perforated casing from the well fluids uphole of well packer.

2. The method of claim 1, additionally comprising the step of connecting the well packer, well perforator and packer closure in an assembly with the perforation located between the well packer and well closure prior to the step of placing the well packer, well perforator and packer closure in the well.

3. The method of claim 2, wherein the step of removing the well perforation additionally comprising disconnecting the well packer from well perforator before passing the perforator through a passageway in the well packer.

4. The method of claim 2 additionally comprises the step of disconnecting the well perforator from the well closure after the step of operating the well perforator.

5. The method of claim 1, wherein said packer closure comprises a production assembly and the step of producing from the perforated well casing through the production assembly.

6. An apparatus for lowering into and for use in perforating a well casing adjacent a subterranean formation while isolating the formation from well fluids in the remainder of the well, the apparatus comprising;

a remotely operable well packer for sealing a well bore, said packer having a passageway extending through said packer, and connector means on one side of said packer for lowering and supporting said well packer in the well;

a remotely operable perforator apparatus with one end releasably connected to said packer, said perforator being of a size to fit through said passageway in said well packer; and a packer closure releasably connected to the other end of said perforator, mating surface means on said packer closure and said well packer for connecting said packer to said packer to closure close said passageway in well packer.

7. The apparatus of claim 6, wherein said packer closure comprises a production assembly.

8. The apparatus of claim 6 additionally comprises tubing positioned between and connected to said well packer and said well perforator.

9. The apparatus of claim 6, additionally comprising tubing positioned between and connected to said well perforator and said packer closure.

10. The apparatus of claim 6, wherein said surface means on said well packer and packer closure comprise mating rachet and teeth.

11. A method of perforating a well casing adjacent a subterranean well formation wherein a well packer is set in a casing containing well fluids in a position above the subterranean well formation for use in isolating the formation from the remainder of the well and wherein a perforator is positioned in the well casing below the well packer and operated to perforate the casing to open up the formation to the casing;

an improvement which comprises positioning a packer closure in the well below the well packer before the well perforator is operated and thereafter simultaneously removing the perforator from the well by moving the perforator through the well packer and closing the packer with a packer closure as the perforator is withdrawn from the well packer thereby preventing communication between the well fluids above the packer and the subterranean formation.

12. The method of claim 11, wherein the step of simultaneously removing comprises moving the perforator through a passageway in said well packer which is slightly larger than said well perforator but smaller than said packer closure.

13. The method of claim 11, additionally comprising the step of releasably connecting the well perforator to the well packer before perforating the casing and disconnecting the well perforator from the well packer before said removing step.

14. The method of claim 13, additionally comprising the step of releasably connecting the well perforator to the packer closure before perforating the casing and disconnecting the well perforator from the packer closure after the perforator is operated.

* * * * *

UNITED STATES PATENT AND TRADEMARK OFFICE

CERTIFICATE OF CORRECTION

PATENT NO. :5,701,957
DATED :December 30, 1997
INVENTOR(S) :Williamson et al.

It is certified that error appears in the above-identified patent and that said Letters Patent is hereby corrected as shown below:

In Column 11, line 47, delete "closure".

Signed and Sealed this

First Day of September, 1998

*Attest:*

*Attesting Officer*

BRUCE LEHMAN

*Commissioner of Patents and Trademarks*